US010745925B2

(12) United States Patent
Dingler et al.

(10) Patent No.: US 10,745,925 B2
(45) Date of Patent: Aug. 18, 2020

(54) CONCRETE FORM ARRANGEMENT HAVING FORM ELEMENTS CONNECTED BY ANCHOR ROD AND METHOD OF PRODUCING THE FORM ARRANGEMENT

(71) Applicant: MEVA Schalungs-Systeme GMBH, Haiterbach (DE)

(72) Inventors: Gerhard Dingler, Haiterbach (DE); Rick Schille, Ebhausen (DE); Jean-Luc Schott, Courtavon (FR)

(73) Assignee: MEVA Schalungs-Systeme GmbH, Haiterbach (DE)

( * ) Notice: Subject to any disclaimer, the term of this patent is extended or adjusted under 35 U.S.C. 154(b) by 119 days.

(21) Appl. No.: 15/944,945

(22) Filed: Apr. 4, 2018

(65) Prior Publication Data

US 2018/0320393 A1 Nov. 8, 2018

(30) Foreign Application Priority Data

May 4, 2017 (EP) ..... 17169517

(51) Int. Cl.
*E04G 17/065* (2006.01)

(52) U.S. Cl.
CPC ..... *E04G 17/0658* (2013.01); *E04G 17/0652* (2013.01); *E04G 17/0657* (2013.01)

(58) Field of Classification Search
CPC ..... E04G 17/0652; E04G 17/0657; E04G 17/0757; E04G 17/0658; E04G 17/0654
USPC ..... 249/40, 42, 43, 213, 216
See application file for complete search history.

(56) References Cited

U.S. PATENT DOCUMENTS 2,116,597 A * 5/1938 Colt ..... E04G 17/0658 249/217
2,172,461 A * 9/1939 Whitescarver ..... E04G 17/0658 411/435
2,314,866 A * 3/1943 Bosco ..... E04G 17/0652 249/43
2,659,125 A * 11/1953 Williams ..... E04G 17/0658 249/42
2,709,292 A * 5/1955 Otti ..... E04G 17/0652 249/43
3,057,034 A * 10/1962 Helmick ..... E04G 17/0714 249/213
3,482,813 A * 12/1969 Wells ..... E04G 17/0721 249/46

(Continued)

FOREIGN PATENT DOCUMENTS

DE 20214936 U1 12/2002
DE 10245187 A1 4/2004

(Continued)

*Primary Examiner* — Michael Safavi
(74) *Attorney, Agent, or Firm* — Von Rohrscheidt Patents

(57) ABSTRACT

For one sided anchoring of two casing elements the invention proposes an anchor including an anchor rod with a thread and an anchor head that is rotationally fixed at the anchor rod to drive the anchor to rotate. A first reaction bearing is arranged at a fixed distance from the anchor head, wherein an enveloping tube that is arrangeable on the anchor rod is supported at the first reaction bearing, wherein a sleeve that forms a second reaction bearing for a casing element that is remote from the anchor head is arranged at another end of the enveloping tube. The invention facilitates one sided anchoring.

5 Claims, 1 Drawing Sheet

(56) References Cited

U.S. PATENT DOCUMENTS 3,822,860 A * 7/1974 Lovisa ..... E04G 17/0714 249/217
3,927,856 A * 12/1975 Lovisa ..... E04G 17/0714 249/177
4,231,541 A * 11/1980 Strickland ..... E04G 17/0714 249/216
5,956,922 A * 9/1999 Liuska ..... E04G 11/065 249/216
6,837,473 B2 * 1/2005 Petkau ..... E04G 17/0657 249/190
8,011,637 B2 * 9/2011 Trimmer ..... E04G 17/0652 249/191
10,480,202 B1 * 11/2019 Colino Vega ..... F16B 21/086
2004/0079860 A1 * 4/2004 Ward ..... E04G 17/045 249/33
2005/0218291 A1 * 10/2005 Musk ..... E04G 17/047 249/43
2008/0173788 A1 * 7/2008 Brewka ..... E04G 11/10 249/189
2008/0307735 A1 * 12/2008 Trimmer ..... E04G 17/047 52/426
2010/0059655 A1 * 3/2010 Schwoerer ..... E04G 17/0657 249/18
2012/0304570 A1 * 12/2012 Braun ..... E04G 17/06 52/426
2014/0374568 A1 * 12/2014 Amon ..... E04G 17/0652 249/1
2015/0167329 A1 * 6/2015 Hagemes ..... E04G 17/0652 52/745.21

FOREIGN PATENT DOCUMENTS

DE 102010002108 A1 8/2011
DE 102014012037 * 2/2016 ..... E04G 17/0652
EP 3112557 A1 1/2017
GB 1004186 A * 9/1965 ..... E04G 17/0652
GB 1072594 A * 6/1967 ..... E04G 17/0652
WO WO2008089737 A1 7/2008

* cited by examiner

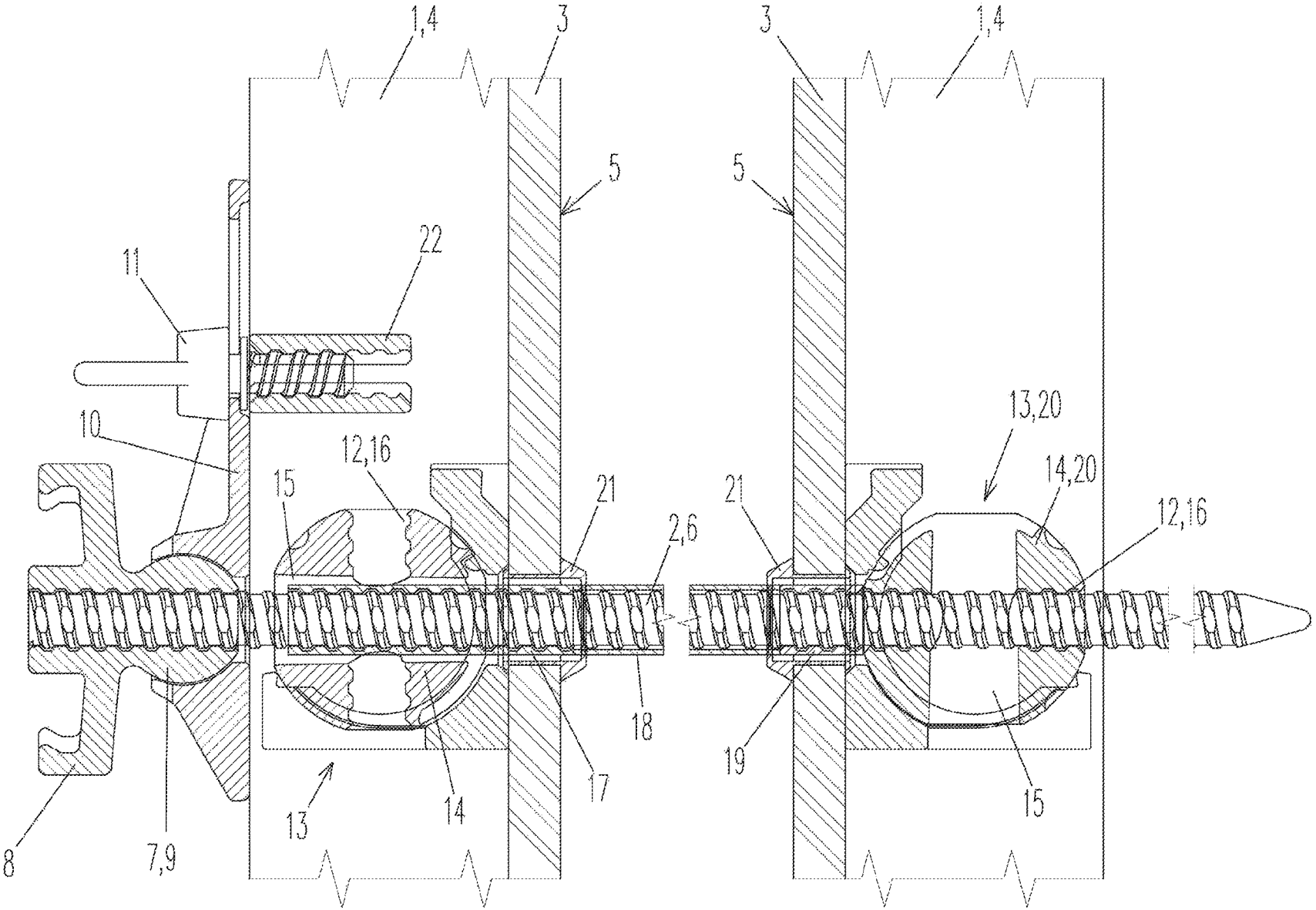
1,4
3
5
13,20
14,20
12,16
15
21
19
2,6
18
17
14
22
13
11
10
7,9
8

CONCRETE FORM ARRANGEMENT HAVING FORM ELEMENTS CONNECTED BY ANCHOR ROD AND METHOD OF PRODUCING THE FORM ARRANGEMENT

RELATED APPLICATIONS

This application claims priority from and incorporates by reference European Patent Application EP 17 169 517.4 filed on May 4, 2017.

FIELD OF THE INVENTION

The invention relates an anchor for connecting two casing elements that are arranged at a distance from each other, a casing arrangement with the anchor and two casing elements that are arranged at a distance from each other and a method for producing the casing arrangement.

BACKGROUND OF THE INVENTION

Casing elements are used for casting concrete elements like ceilings or walls. Frame casing elements are known which include a plate made from wood, synthetic material or metal as a casing shell and a frame with longitudinal and transversal beams made from metal for reinforcement on a side of the casing shell that is the back side. The invention is not limited to casing elements of this type. In order to cast a wall from concrete two casing elements are placed at a distance from each other. The distance corresponds to a thickness of the wall to be cast. The casing elements are connected with anchors so that they sustain a pressure of liquid concrete that is filled in between the casing elements. After curing the concrete the anchors are removed before the casing element can be removed.

An anchor for connecting two casing elements that are arranged opposite to each other at a distance from each other is disclosed in the application publication document DE 10 245 187 A1. The known anchor includes a threaded rod which is inserted through pass through openings in the two casing elements and onto which wing nuts are threaded at outsides or back sides of the casing elements that are oriented away from each other and which hold the two casing elements together. Between the casing elements an enveloping tube is arranged on the threaded rod of the known anchor wherein hollow cones are inserted into ends of the envelopment tube which cones are arranged on the threaded rod like the envelopment tube and which contact sides of the casing elements that are oriented towards each other with a washer arranged there between. The enveloping tube together with the two hollow cones and the washers keeps the casing elements at a distance from each other. In order to connect the two casing elements the known anchor requires accessibility of the outsides of the two casing elements that are oriented away from each other.

BRIEF SUMMARY OF THE INVENTION

Thus, it is an object of the invention to propose an anchor for one sided anchoring, this means an anchor for connecting two casing elements that are arranged opposite to each other at a distance wherein the anchor can be attached from one side without accessibility of the other side. It another object of the invention to propose a casing arrangement with two casing elements that are arranged at a distance from each other and a method for arranging the casing element which facilitates one sided anchoring.

The object is achieved by an anchor configured to connect two casing elements that are arranged at a distance from each other and opposite to each other, the anchor comprising an anchor rod that includes a thread on which an enveloping tube is arrangeable, wherein the anchor rod includes an anchor head that is rotationally and axially fixed at the anchor rod and a first reaction bearing for the enveloping tube at a fixed distance from the anchor head.

The object is also achieved by a casing arrangement, comprising two casing elements that are arranged at a distance from each other and connected by the anchor recited supra wherein the two casing elements include anchor holes through which the anchor rod is inserted and wherein the enveloping tube is arranged on the anchor rod between the two casing elements, wherein the enveloping tube is supported at the first reaction bearing of the anchor rod, wherein a second reaction bearing contacts the enveloping tube, wherein a casing element that is remote from the anchor head of the anchor rod includes an inner thread into which the anchor rod is threaded, and wherein the casing element that is remote from the anchor head contacts the second reaction bearing of the anchor rod.

Last not least the object is achieved by a method for constructing the casing arrangement recited supra, the method comprising the steps inserting the anchor rod with the enveloping tube that contacts the first reaction bearing and with the second reaction bearing that contacts the end of the enveloping tube that is remote from the first reaction bearing from one side through the anchor holes of the two casing elements, and threading the anchor rod into the inner thread of the casing element that is remote from the anchor head so that the casing element that is remote from the anchor head contacts the second reaction bearing of the anchor rod and the two casing elements are supported at a distance from each other.

The anchor according to the invention with the features recited supra includes an anchor rod with a thread. An enveloping tube is arrangeable on the anchor rod. The enveloping tube prevents a contact of the anchor with concrete and an encasement of the anchor with the concrete. After casting the concrete the anchor can be pulled out of the enveloping tube whereas the enveloping tube remains in the concrete or is removed. The anchor rod of the anchor according to the invention includes a thread which can continue over a length of the anchor rod, however, it does not have to. For example the anchor rod of the anchor according to the invention is a so called Dywidag rod. The Dywidag rod has a special thread with a turn that does not continue in the circumferential direction but which is interrupted at two opposite sides of the rod.

The anchor rod of the anchor according to the invention includes an anchor head that is connected rotationally and axially with the anchor rod and a first reaction bearing for the enveloping tube at a fixed distance from the anchor head. The anchor head is used as a reaction bearing on an outside or back side of one of the two casing element that is proximal to the anchor head or arranged at the anchor head. Furthermore the anchor head facilitates threading the anchor rod into an interior thread at the other of the two casing elements that is remote from the anchor head. The anchor head can be for example a polygon so that a rotation tool can be applied torque proof like for example of an open end wrench, or a box wrench, a polygonal socket or an impact driver and/or can include lobes like a wing nut for rotating the anchor by hammer strikes. The enumeration is exemplary and not exclusive.

The first reaction bearing positions an enveloping tube that is arranged on the anchor rod and which contacts the first reaction bearing wherein the positioning is performed with reference to a casing surface of a casing element that is proximal to the anchor head. Thus, the casing surface is a surface of the casing element that is oriented away from the anchor head wherein the casing surface contacts the concrete during casting and forms a surface of the concrete. An end of the enveloping tube can be arranged in the same plane as the casing surface, in front or behind the casing surface. In the latter case the enveloping tube penetrates the casing surface. Advantageously the enveloping tube is no longer than a distance of the casing surfaces of the two casing elements, thus does not penetrate the casing surfaces of the two casing elements so that the enveloping tube does not protrude from the concrete after casting. The first reaction bearing can be fixed axially on the anchor rod. Another embodiment is a sleeve or another first reaction bearing that is axially moveable on the anchor rod and which is supported at the anchor head.

Advantageously the anchor according to the invention includes a second reaction bearing for a switching element that is remote from the anchor head that is placeable onto the anchor rod on a side of the first reaction bearing that is oriented away from the anchor head. An enveloping tube, if available is arranged between the two reaction bearings on the anchor rod. Together with the second reaction bearing the enveloping tube and first reaction bearing define a distance of the two casing elements when the enveloping tube contacts the first reaction bearing, the second reaction bearing contacts the enveloping tube and the casing element that is remote from the anchor head contacts the second reaction bearing. A length of an enveloping tube that is arranged on an anchor rod of the anchor according to the invention defines the distance of the two casing elements that are connected by the anchor, wherein the distance of casing surfaces of the two casing elements can be the same size, larger or smaller than the enveloping tube. The anchor is always the same for different distances of the casing elements as long as its anchor rod is long enough. Only the length of the enveloping tube has to be adapted to the distance of the two casing elements.

The second reaction bearing can be movable in the longitudinal direction of the anchor rod and can be supported at the enveloping tube or it can be axially attachable at the anchor rod. The second reaction bearing can include for example an interior thread by which it is threadable or threaded onto the thread of the anchor rod. Also in this case the second reaction bearing is advantageously brought in contact with an end of the enveloping tube that is arranged on the anchor rod between the two reaction bearings and which contacts the first reaction bearing with its other end.

Advantageously the anchor includes an attachment device for fixing at a casing element that is proximal to the anchor head and which contacts the anchor head. The attachment device can be for example a bolt which is threaded from a back side into the casing element and which attaches the anchor head together with the anchor rod at the casing element in a rotatable manner.

The casing arrangement according to the invention includes two casing elements that are arranged at a distance from each other and which are connected with an anchor of the type recited supra and held at a distance from each other. The two casing elements include anchor holes or anchor locations through which the anchor rod is inserted. Between the casing elements an enveloping tube is arranged on the anchor rod wherein the enveloping tube advantageously does not penetrate casing surfaces of the two casing elements but terminates at or in front of the casing surfaces. An end of the enveloping tube is supported at the first reaction bearing of the anchor wherein the first reaction bearing has a fixed distance from the anchor head. When one of the two casing elements that is proximal to the anchor head contacts the anchor head the first reaction bearing fixes a first end of the enveloping tube with reference to the casing element that is proximal to the anchor head and with respect to its casing surface. A casing element that is remote from the anchor head includes an inner thread into which the thread of the anchor rod is threaded to fix the anchor rod at the casing element that is remote from the anchor head and to clamp the two casing elements together at a distance from each other. The casing element that is remote from the anchor head can include for example an anchor lock or a nut which is arranged torque proof at the casing element and which includes the inner thread into which the anchor rod is threaded wherein the inner thread is aligned with the anchor hole. Another option is a casing element whose frame includes the inner thread into which the anchor rod is threaded. The second reaction bearing is arranged on the anchor rod wherein the second reaction bearing contacts an end of the enveloping tube that is remote from the first reaction bearing. The two reaction bearings and the enveloping tube that is arranged between them on the anchor rod wherein the two ends of the enveloping tube contact the reaction bearings hold the casing element that is remote from the anchor head at a distance from the first reaction bearing and from the anchor head and the anchor clamps the two casing elements together at a distance with the thread of its anchor rod that is threaded into the inner thread of the casing element that is remote from the anchor head and with the anchor head.

In an advantageous embodiment of the invention gaskets are arranged at the anchor holes of the casing element wherein the gaskets seal between the casing elements and the enveloping tube so that no concrete exits through the anchor holes.

An embodiment of the invention provides that a seal at the casing element that is remote from the anchor head includes a reaction bearing for the second reaction bearing of the anchor head. In this case the second reaction bearing does not support the casing element that is remote from the anchor head directly but through the gasket and keeps the two casing elements at a distance from each other in this manner.

The method according to the invention with the features according to claim 8 is directed to one sided anchoring where two casing elements that are arranged at a distance from each other are connected from one side with an anchor of the type recited supra. Accessibility of a back side of one of the two casing elements that is oriented towards the other casing element suffices, the other casing element does not have to be accessible for connecting with the anchor. According to the invention the anchor rod on which an enveloping tube and the second anchor rod are arranged is inserted from one side through the anchor holes of both casing elements and threaded into an inner thread of a casing element that is remote from the anchor head and aligned with the anchor hole. For threading the anchor rod can be rotated with the anchor head which is fixed rotationally and axially with the anchor rod. Thus, the two casing elements can be clamped together. The enveloping tube contacts the first reaction bearing and the second reaction bearing contacts the enveloping tube or the enveloping tube contacts the first reaction baring and the second reaction baring contacts the enveloping tube when the anchor rod is inserted through the anchor holes of the two casing elements or when the two casing elements are clamped together. When the anchor rod is threaded into the inner thread of the casing element that is remote from the anchor head and when the two casing elements are clamped together the casing element that is remote from the anchor head contacts the second reaction bearing so that the two casing elements are clamped together and held at a distance from each other. Clamped together means that the two casing elements are held at a distance from each other and prevented from moving away from each other, thus from increasing their distance. Clamping together does not mean that a distance of the casing elements is reduced or that the two casing elements come in contact with each other.

Advantageously the anchor head is attached with an attachment device at a back side of the casing element that is proximal to the anchor head wherein the back side is oriented away from the anchor head.

At least at the anchor hole of a casing element that is remote from the anchor head a seal is arranged before or when the anchor head is inserted through the anchor hole. The seal element seals between the casing element and the enveloping tube. A seal is also provided at the anchor hole of the casing element that is proximal to the anchor head, wherein the seal can be arranged at the anchor hole of the casing element when the anchor rod is inserted or the seal is arranged on the anchor rod and is inserted through the anchor hole together with the anchor rod.

BRIEF DESCRIPTION OF THE DRAWINGS

The invention is subsequently described in more detail with reference to an embodiment that is illustrated in the drawing FIGURE. The only drawing FIGURE illustrates a casing arrangement with an anchor according to the invention.

DETAILED DESCRIPTION OF THE INVENTION

The casing arrangement according to the invention that is illustrated in the drawing FIGURE includes two casing elements 1 that are arranged parallel to one another at a distance from each other which are connected by plural anchors 2 that are distributed over their surfaces wherein only one anchor is illustrated in the drawing FIGURE. In the embodiment the casing elements 1 are frame casing elements with flat plates from wood, plastic material or metal configured as casing shells 3 which are reinforced by frames 4 that include longitudinal and transversal beams on their back sides that are oriented away from each other. The beams of the frame 4 are rectangular metal tubes in the illustrated embodiment. Surfaces of the casing shells 3 that are oriented away from the frames 4 form casing surfaces 5 of the casing shells 3 and of the casing elements 1. They are oriented towards each other in the casing arrangement. When a wall is cast with concrete the two casing elements 1 are set up standing upright and flow capable concrete is filled between the casing elements 1, wherein the casing surfaces 5 of the casing elements 1 come in contact with the concrete and form its surface.

The anchor 2 according to the invention includes an anchor rod 6 with a thread. In the illustrated embodiment the anchor rod 6 is a so called Dywidag rod with a special thread whose turns are not continuous in the circumferential direction but interrupted at two opposite locations over an entire length of the rod, this means each turn of the thread is interrupted twice on opposite sides of the rod. The Dywidag rod is not required for the invention.

At one end a nut is threaded onto the anchor rod 6 and compressed so that it is attached torque proof at the anchor rod 2. The nut can also be attached torque proof at the anchor rod 2 in a different manner. Through the thread the nut is also axially fixated at the anchor rod 2. The nut forms an anchor head 7 of the anchor 2 that is rotationally and axially fixated at the anchor rod 6. In the embodiment the nut is a wing nut whose wings 8 facilitate a rotating, tightening or loosening of the anchor 2 with hammer strikes. A rotation drive is also feasible by applying a non-illustrated rotation tool like for example an open end wrench or a boxed wrench or an impact driver which is applied through form locking torque proof to the nut forming the anchor head 7.

The anchor head 7 includes a ball section 9 that is rotatable and pivotable like a ball joint in all directions and received in a so called spherical section plate 10 which envelops the anchor head 7 in a circular manner and which protrudes in a direction that is radial to the anchor head beyond the circular shape. There the spherical section plate 10 includes a bolt, in the embodiment an eye bolt, as an attachment device for attaching the anchor head 7 or the anchor 2 at one of the two casing elements 1. The eye bolt that forms the attachment device 11 is threaded into an inner threaded sleeve 22 in the frame 4 of the casing element 1 and fixes the spherical section plate 10 with the anchor head 7 on the back side of the frame 4 of the casing element 1 wherein the back side is oriented away from the other casing element 1 and the spherical section plate 10 is fixed at the anchor head 7.

The anchor rod 6 penetrates anchor holes in the frames 4 and in the casing shells 3 of the casing elements 1 and is threaded into an inner thread 12 of the casing element 1 that is remote form the anchor head 7. For the inner thread the casing element 1 can include a sleeve with an inner thread or a nut which is welded into a carrier of the frame 4 of the casing element 1 or a nut which is engaged at the frame 4 or arranged in another disengageable or non-disengageable manner. In the embodiment the casing element 1 includes an anchor lock 13 which is arranged on a backside of the casing shell 3 at or in a carrier of the frame 4 of the casing element 1. The anchor lock 13 includes a rotatable lock element 14 that is circular in a side view and which includes a pass through hole 15 without a thread and an interior thread hole 16 with the inner thread 12 that is also continuous and intersects the pass through hole 15 in an orthogonal direction. The pass through hole 15 without the thread and the hole 16 with the inner thread can be aligned by rotating the closure element 14 by 90° optionally with the anchor hole for the anchor rod 6 of the anchor 2 in the casing shell 3 of the casing element 1.

In the embodiment both casing elements 1 include an anchor lock 13 of this type wherein the closure element 14 of the anchor lock 13 of the casing element 1 that is remote from the anchor head 7 is rotated so that the hole 15 with the inner thread is aligned with the anchor hole in the casing shell 3 so that the anchor rod 6 is threadable into the inner thread 12. The lock element 14 of the anchor lock 13 of the casing element 1 proximal to the anchor head 7 at whose frame the spherical element plate 10 with the anchor head 7 is fixated is aligned so that its thread-less pass through hole 15 is aligned with the anchor hole for the anchor rod 6 in the casing shell 3 so that the anchor rod 6 is insertable without the thread being engaged.

Proximal to the anchor head 7 a threaded sleeve is threaded onto the anchor rod 6 as a first axial reaction bearing 17 for an enveloping sleeve 18 and connected torque proof with the anchor rod 6 through welding, gluing, pressing or in another manner so that the first reaction bearing 17 is arranged torque proof and in particular axially fixed at a fixed axial distance from the anchor head 7 and the spherical element plate 10 of the anchor 2 on the anchor rod 6. The reaction bearing 17 protrudes a short distance on a side of the casing surface 5 from the casing shell 3. The enveloping tube 18 is arranged between the casing elements 1 and their casing shells 3 on the anchor rod 6.

At an end of the enveloping tube 18 that is remote from the anchor head 7 an additional sleeve is arranged as a second axial reaction bearing 19 on the anchor rod 6. The second reaction bearing 19 is arranged in the casing arrangement according to the invention in the casing shell 3 of the casing element 1 that is remote from the anchor head 7 and is supported on one side axially at the enveloping tube 18 and supports on the other side the casing element 1 axially at the anchor rod 6 or through the enveloping tube 18 at the anchor 2. In this embodiment the second reaction bearing 19 supports the casing element 1 at the anchor lock 13 or at its locking element 14. The anchor lock 13 or its lock element 14 form a reaction bearing 20 of the casing element that is remote from the anchor head 7 through which the casing element 1 contacts the second reaction bearing 19 of the anchor 2. The second reaction bearing 19, however, can support the casing element 1 also in another manner or at another location axially at the anchor 2.

The second reaction bearing 19 has an axial length so that it protrudes like the first reaction bearing 17 by a short distance on the side of the casing shell 15 from the casing shell 3 of the casing element 1 when the anchor lock 13 or the lock element 14 contact the second reaction bearing 19 or when the casing element 1 is supported at the second reaction bearing 19. A length of the enveloping tube 18 determines a distance of the two casing elements 1 or of their casing surfaces 5 from each other. Thus, the anchor 2 itself is usable for any distances of the casing elements 1 from each other if its anchor rod 6 is long enough. For a smaller distance of the casing elements 1 from each other the anchor rod 6 protrudes further on the back side of the casing element 1 that is remote from the anchor head 7, compared to a larger distance of the casing elements 1 from each other.

After casting and curing the concrete the enveloping tube 18 remains in the concrete and the anchor 2 is initially threaded out of the inner thread 12 of the casing element 1 that is remote from the anchor head 7 and is subsequently pulled out of the enveloping tube 18 and the casing element 1 that is proximal to the anchor head 7. The eye bolt at the spherical element plate 10 that forms the attachment device 11 is previously disengaged from the frame of the casing element 1 that is proximal to the anchor head 7.

The enveloping tube 18 is advantageously slightly shorter than the distance between the casing surfaces 5 of the casing elements 1 and the two reaction bearings 17, 19 advantageously protrude slightly from the casing shells 3, so that the enveloping tube 18 is embedded into the concrete and does not protrude from the concrete. The enveloping tube 18 can be as long as the distance of the casing surfaces 5 and the reaction bearing 17, 19 can be flush with the casing surfaces 5. In this case the enveloping tube 18 terminates flush with the surfaces of the concrete. Though not explicitly provided but also not excluded by the invention is an embodiment where the enveloping tube 18 is longer than a distance of the casing surfaces 5 of the two casing elements 1 from each other so that the enveloping tube 18 protrudes from the concrete.

Grommet shaped seals 21 are arranged in the anchor holes of the casing shells 3 of the 2 casing elements 1 wherein the seals have a frustum shaped flange on the casing surfaces 5 and form frustum shaped depressions into the surface of the concrete at the location of the enveloping tube 18. The seals 21 protrude further on the sides of the encasement surfaces 5 from the casing surfaces 5 from the casing shells 3 than the reaction bearings 17, 19 so that both ends of the enveloping tube 18 protrude into the seals 21. The seals 21 seal between the casing shells 3 of the casing elements 1 and the enveloping tube 18. When removing the casing elements 1 after concrete casting the seal elements 21 remain in the anchor holes of the casing shells 3 of the casing elements 1.

In order to construct the casing arrangement according to the invention, this means connect the casing elements 1 with the anchor 2 the casing elements 1 are arranged parallel to one another and at a distance from each other so that their casing surfaces 5 are oriented towards each other and their anchor holes are aligned with each other. Alignment errors can be compensated by slanting the anchor 2 or the anchor rod 6. The locking elements 14 of the anchor locks 13 are rotated so that the thread-less pass through hole 15 of the locking element 14 of the casing element 1 and the inner thread hole 16 of the locking element 14 of the anchor lock 13 of the other casing element 1 are aligned with the anchor holes in the casing shells 3 of the casing elements 1. The anchor rod 6 of the anchor 2 is inserted from a back side of the casing element 1 that is oriented away from the other casing element 1 in which casing element the thread-less pass through hole 15 of the lock element 14 of the anchor lock 13 is aligned with the pass through hole 15 in the casing shell 3 through the pass through hole 15 in the lock element 14 and the anchor hole in the casing shell 3 of casing elements 1 and through the anchor hole in the casing shell 3 of the other casing element 1 and threaded into the inner threaded hole 16 of the lock element 14 of the anchor lock 13 of the other casing element 1 that is remote from the anchor head 7 and tightened by driving the anchor head 7 to rotate.

Thus, the anchor 2 clamps the two casing elements 1 together which are kept at a distance from each other by the enveloping tube 18 that is supported at the first reaction bearing 17 of the anchor 2 and at which the second reaction bearing 19 of the anchor 2 is supported. Furthermore the spherical element plate 10 which supports the anchor head 7 so that it is rotatable and pivotable in all directions is fixed by the eye bolt forming the attachment device 11 at a back side of the frame 4 of the casing element 1 which back side is oriented away from the casing shell 3. When the anchor rod 6 is inserted the seals 21 are arranged in the anchor holes of the casing shells 3 and the enveloping tube 18 and the second reaction bearing 19 are placed onto the anchor rod 6. As illustrated the second reaction bearing 19 can include an inner thread and is threaded against the enveloping tube 18 in this case before the anchor rod 6 is inserted through the casing elements 1 so that the enveloping tube 18 contacts the first reaction bearing 17. The second reaction bearing 19 can also be provided without a thread and thus axially movable on the anchor rod 6. The second reaction bearing 19 then attaches at the enveloping tube 18 when the anchor rod is inserted through the seals 21 and the enveloping tube 18 contacts the reaction bearing 17. Connecting the two casing elements which is also designated as anchoring the casing elements 1 is performed from a back side of the two casing elements 1. The other casing elements 1 does not have to be accessible. The invention facilitates a so called one sided anchoring from one side without the other side of the two casing elements being accessible.

What is claimed is:

1. A casing arrangement, comprising:

two casing elements that are arranged at a distance from each other and connected by an anchor configured to connect two casing elements that are arranged at a distance from each other and opposite to each other, the anchor including an anchor rod that includes a thread on which an enveloping tube is arrangeable so that the anchor rod is axially movable in the enveloping tube, wherein the anchor rod includes an anchor head that is rotationally and axially fixed at the anchor rod and a first reaction bearing for the enveloping tube at a fixed distance from the anchor head, wherein the two casing elements include anchor holes through which the anchor rod is inserted and wherein the enveloping tube is arranged on the anchor rod between the two casing elements, wherein the enveloping tube is supported at the first reaction bearing of the anchor rod, wherein a second reaction bearing contacts the enveloping tube, wherein a casing element that is remote from the anchor head of the anchor rod includes an inner thread into which the anchor rod is threaded, wherein the casing element that is remote from the anchor head contacts the second reaction bearing of the anchor rod, wherein seals are arranged at the anchor holes of the two casing elements, and wherein the seals seal between the two casing elements and the enveloping tube.

2. The casing arrangement anchor according to claim 1, wherein the anchor includes an attachment device configured to provide fixing at a casing element that is proximal to the anchor head.

3. The casing arrangement according to claim 1, wherein one of the seals includes a reaction bearing for the second reaction bearing of the anchor rod at the casing element that is remote from the anchor head.

4. A method for constructing the casing arrangement according to claim 1, the method comprising:

inserting the anchor rod with the enveloping tube that contacts the first reaction bearing and with the second reaction bearing that contacts the end of the enveloping tube that is remote from the first reaction bearing from one side through the anchor holes of the two casing elements, and threading the anchor rod into an inner thread of the casing element that is remote from the anchor head so that the casing element that is remote from the anchor head contacts the second reaction bearing of the anchor rod and the two casing elements are supported at a distance from each other.

5. The method according to 4, wherein a seal is arranged at an anchor hole of the casing element that is remote from the anchor head when the anchor rod is inserted through the anchor hole, and wherein the seal seals between the casing element and the enveloping tube.

* * * * *